United States Patent [19]

Okamoto

[11] Patent Number: 4,678,388

[45] Date of Patent: Jul. 7, 1987

[54] APPARATUS FOR COUNTING AND COLLECTING PAPER BOARDS

[75] Inventor: Arifumi Okamoto, Mihara, Japan

[73] Assignee: Mitsubishi Jukogyo Kabushiki Kaisha, Tokyo, Japan

[21] Appl. No.: 902,077

[22] Filed: Aug. 28, 1986

Related U.S. Application Data

[63] Continuation of Ser. No. 738,510, May 28, 1985, abandoned, which is a continuation of Ser. No. 460,981, Jan. 25, 1983, abandoned.

[30] Foreign Application Priority Data

Feb. 2, 1982 [JP] Japan ..... 57-15155

[51] Int. Cl.[4] ..... B65G 57/30

[52] U.S. Cl. ..... 414/92; 414/43; 414/46

[58] Field of Search ..... 414/43, 46, 92, 93, 414/114, 96

[56] References Cited

U.S. PATENT DOCUMENTS

| | | | |
|---|---|---|---|
| 3,194,127 | 7/1965 | Larsson | 414/43 X |
| 3,744,649 | 7/1973 | Ward, Jr. | 414/46 X |
| 3,834,290 | 9/1974 | Nelson | 414/46 X |

*Primary Examiner*—Robert J. Spar
*Assistant Examiner*—Janice Krizek
*Attorney, Agent, or Firm*—Holman & Stern

[57] ABSTRACT

An apparatus for counting and collecting paperboards which counts, by a counting device, at an inlet thereof, the paperboards brought by a conveyor device, heaps them up successively from the bottom thereof by restraining their movement with a stopper disposed on the surface of a conveyor, and transfers them to a further process each time they are collected as many as a predetermined number, characterized in that the stopper is composed of a shaft for rotating itself intermittently in response to a signal from the counting device, a plurality of stopper members which are rockingly disposed around the shaft and which are urged in the rotational direction of the shaft, and torsion springs, disposed on the shaft, for restraining the rocking movement of each stopper member in the vicinity of an upright position thereof, and the shaft stops its intermittent rotation at a working position of each stopper member and at an approximately middle position between a stopper member at said working position and an adjacent stopper member.

5 Claims, 10 Drawing Figures

APPARATUS FOR COUNTING AND COLLECTING PAPER BOARDS

This is a continuation of application Ser. No. 738,510, filed May 28, 1985, now abandoned, which in turn is a continuation of Ser. No. 460,981, filed 01/25/83 (now abandoned).

BACKGROUND OF THE INVENTION

The present invention relates to an underfeed type of apparatus for counting paperboards.

Description of the Prior Art

A conventional apparatus for counting and collecting paperboards of this type is shown as one example in accompanying FIGS. 1 to 3. Paperboards 1 which have been subjected to grooving, fold formation, paste coating, and folding treatments in the preceding process are carried in an arrow direction in FIG. 1 and are heaped up in a hopper 2. The front and rear walls of the hopper 2 are composed of a gate constructing member 3, a squaring plate 4 and a sheet supporting member 5, and the scaring plate 4 can vibrate itself. The paperboard 1a which has been correctly placed in the hopper 2 by the vibration is sent out one by one through the space between a feed conveyor 6 disposed underneath the hopper 2 and the lower edge of the gate constructing member 3 by means of the conveyor 6 at a rate substantially equal to the rate at which the paperboards are introduced into the hopper 2 from the preceding process.

Each paperboard **1*b* which has been sent out from the conveyor 6 is transferred to a stacker conveyor 7. An inlet of the stacker conveyor 7 is arranged at a higher level than the feed conveyor 6 so that the paperboards may be easily heaped from the bottom thereof. Further, a phototube 8 is provided at the inlet of the stacker conveyor 7, and the paperboards are counted by the passage thereof across the light oriented to the phototube 8. Heaping the paperboards is carried out in the middle of the stacker conveyor 7. That is to say, the bottom paperboard 1c is stopped by lugs 9 which are oppositely disposed across the stacker conveyor and it is then pushed up by the next coming paperboard 1*b*. In this way, the heap of the paperboards is made up. When the number of the heaped paperboards attains a predetermined level, a shaft 10 having the above lugs 9 rotates in an arrow direction to release and forwards the heaped paperboards 11 by the stacker conveyor 7. As seen in FIG. 2, next lugs 9*a*, simultaneously with the rotation of the shaft 10, are brought into contact with the bottom of the paperboards with a smaller spring force than the weight of the heap of the paperboards, and wait for a next coming paperboard 1*d* with the intention of stopping it. Then, immediately when the heap has passed therethrough, the lugs return to the stopping position (FIG. 3**) and begin to heap up the paperboards again.

In this apparatus, however, as soon as the heaped paperboards 11 have been released from the lugs, they are moved by means of the stacker conveyor 7 at a high speed. Therefore, the heap of the paperboards tends to get out of order, particularly the paperboards having a shorter length in the moving direction are liable to do so. Further, even after the heap has been released, the newly coming paperboards begin to be stacked up from the bottom of the completed heap, therefore at that time the rear edge of the heap is raised, which increase the likelihood of the heap being upset. For the prevention of such a drawback, it is necessary to reduce the speed of the stacker conveyor 7.

Now, reference will be made to another conventional apparatus for counting and collecting paperboards which is shown in FIGS. 4 to 6. The processes before the conveyance of the paperboards up to a stacker conveyor 15 are omitted, since being the same as mentioned above. Paperboards 16 are then carried by a stacker conveyor 15 until they hit against a stationary stop rod 17 and are heaped up successively from the bottom thereof. When the paperboards have been counted as many as a predetermined number, an intermediate stop rod 18 is elevated above the level of the conveyor belt 15 to stop the next coming paperboard (FIG. 5). After the paperboards have been heaped up to a predetermined number, the intermediate stop rod 18 is further raised up (FIG. 6), so that the heap of the paperboards is caused to pass over the stationary stop rod 17. Then, the heap is transferred to a discharge conveyor 19, which is disposed at a higher level than the stationary stop rod, by a push device 20 (which can slide vertically).

Also in this apparatus, however, the heaped paperboards tend to get out of order, since raised by the intermediate stop rod. Further, even after the intermediate stop rod begins the paperboard stopping operation, the paperboards are required to be further heaped up to the height at which the heap is permitted to be pushingly forwarded, therefore it is difficult to carry out this work in a speedy cycle.

SUMMARY OF THE INVENTION

In view of the above-mentioned conventional drawbacks, an object of the present invention is to provide an apparatus for counting and collecting paperboards which can prevent the paperboards from getting out of order at the time of heaping and discharging of them and which is applicable to a high speed operation.

According to the present invention, there is provided an apparatus for counting and collecting paperboards which counts, by a counting device, at an inlet thereof, the paperboards brought by a conveyor device, heaps up them successively from the bottom thereof by restraining their movement with a stopper disposed on the surface of a conveyor, and transfers them to a further process each time they are collected as many as a predetermined number, characterized in that the stopper is composed of a shaft for rotating itself intermittently in response to a signal from the counting device, a plurality of stopper members which are rockingly disposed around the shaft and which are urged in the rotational direction of the shaft by means of a spring, and means, disposed on the shaft, for restraining the rocking movement of each stopper member in the vicinity of an upright position thereof, and the shaft stops its intermittent rotation at a working position of each stopper member and at an approximately middle position between two adjacent stopper members.

DETAILED DESCRIPTION OF THE INVENTION

Figure 1:
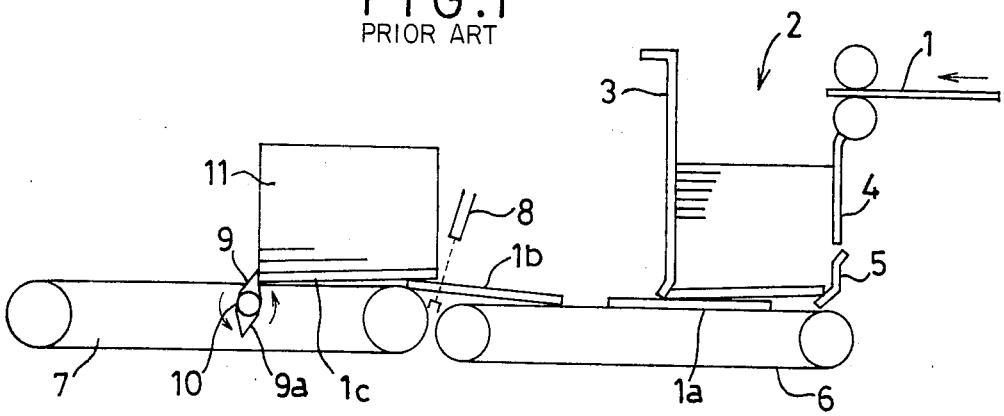
FIG.1 PRIOR ART
Figure 2:
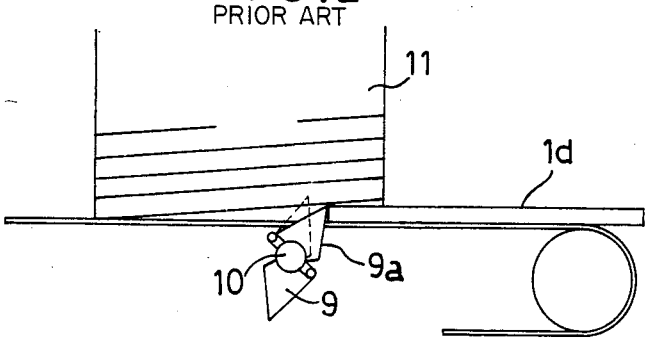
FIG.2 PRIOR ART
Figure 3:
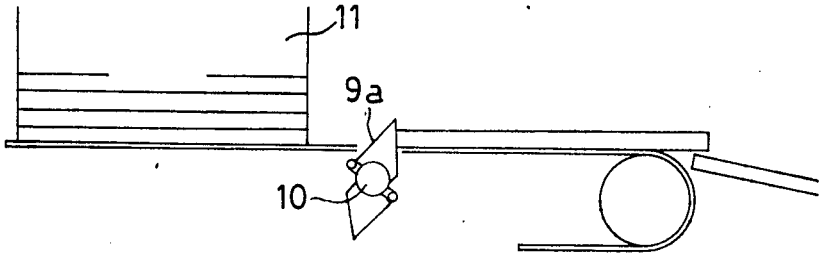
FIG.3 PRIOR ART
Figure 4:
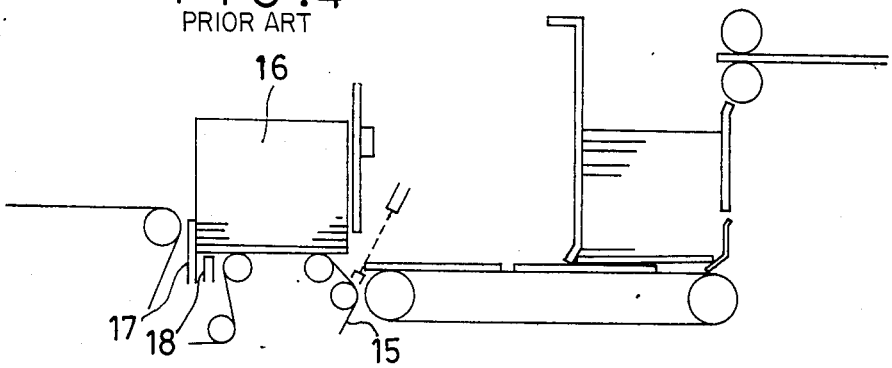
FIG. 4 PRIOR ART
Figure 5:
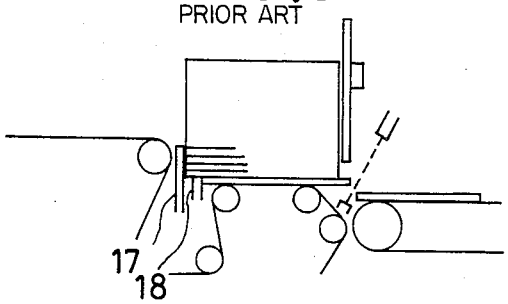
FIG. 5 PRIOR ART
Figure 6:
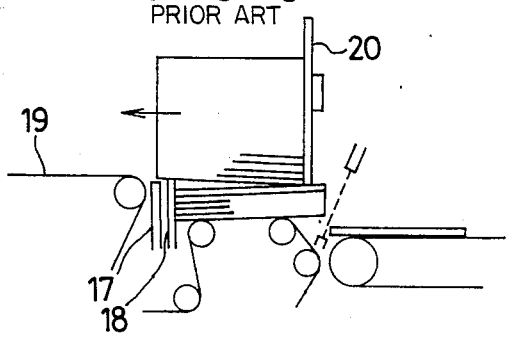
FIG. 6 PRIOR ART
Figure 7:
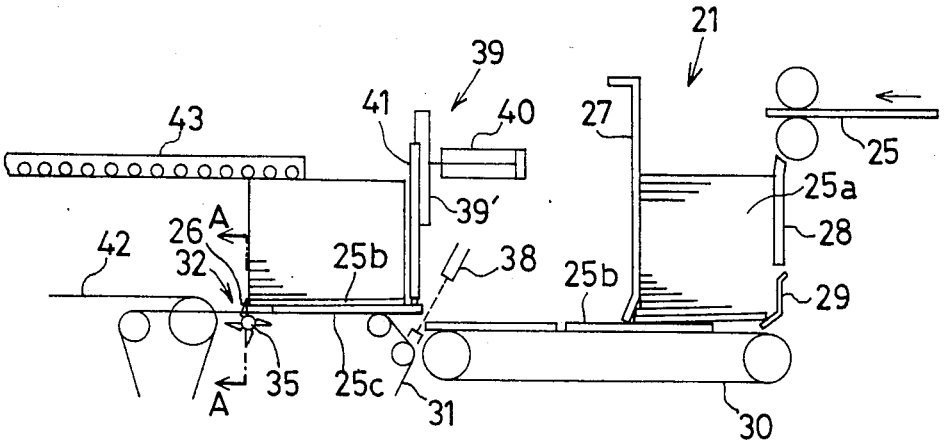
Figure 8:
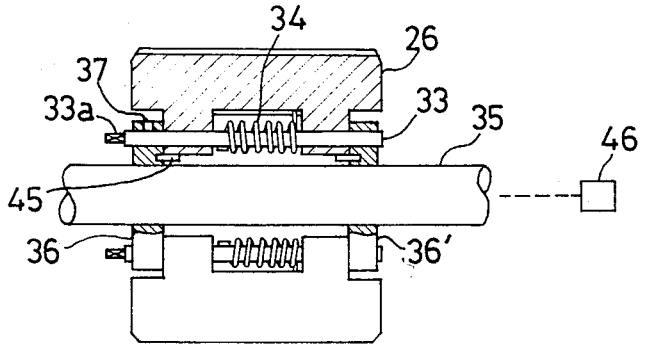
Figure 9:
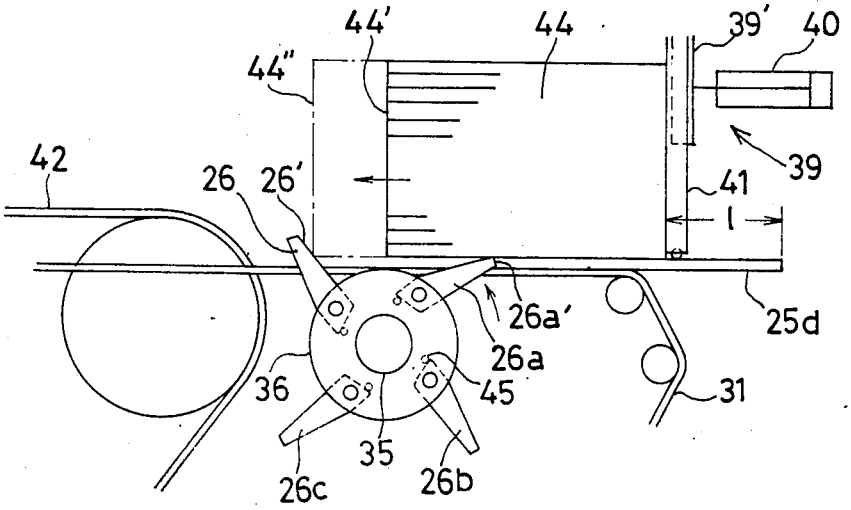
Figure 10:
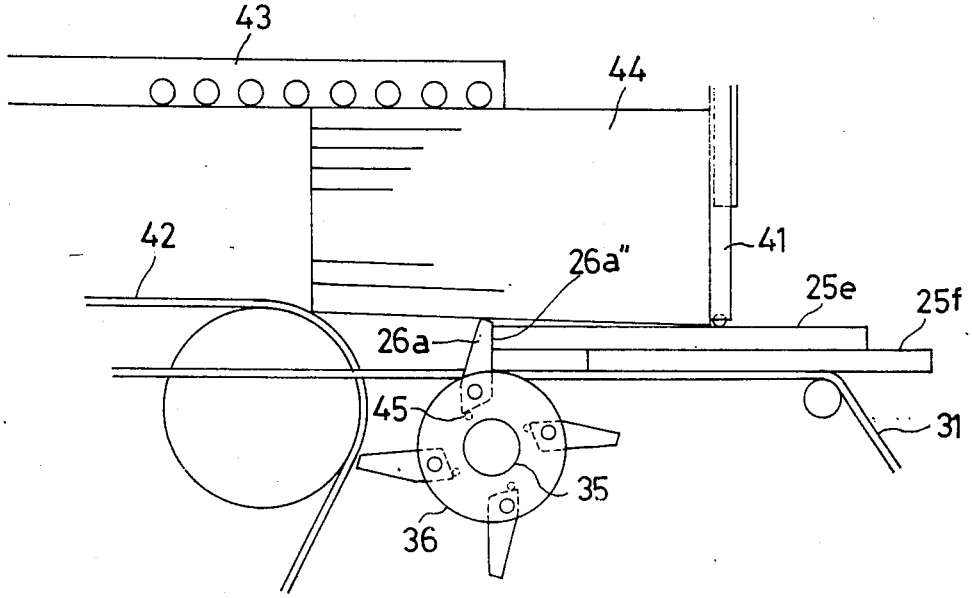

Other objects and advantages of the present invention will be manifested from the following example with reference to the accompanying drawings, in which:

FIGS. 1 to 3 show a conventional apparatus for counting and collecting paperboards, and FIG. 1 is an illustrative side view exhibiting the schematic constitution of the entire apparatus, FIGS. 2 and 3 are enlarged side views exhibiting a portion of FIG. 1 to illustrate the function of the apparatus;

FIGS. 4 to 6 show another conventional apparatus for counting and collecting paperboards, and FIG. 4 is an illustrative side view exhibiting the schematic constitution of the entire apparatus, FIGS. 5 and 6 are enlarged side views exhibiting a portion of FIG. 4 to illustrate the function of the apparatus; and FIGS. 7 to 10 show one example of the present invention, and FIG. 7 is an illustrative side view exhibiting the schematic constitution of the entire apparatus according to the present invention, FIG. 8 is a sectional view taken along the line A—A in FIG. 7, FIG. 9 is an enlarged side view exhibiting a portion of FIG. 7, and FIG. 10 is a side view similar to FIG. 9.

The description of the present invention will be given in detail in accordance with the most preferable example shown in FIGS. 7 to 10.

Paperboards 25 which have already been subjected to grooving, fold formation, paste coating, and folding treatments in the preceding process are carried in an arrow direction and are introduced into a hopper 21. The hopper 21 is composed of a gate constructing member 27, a squaring plate 28 and a sheet supporting member 29. The squaring plate 28 serves to correct curved or disordered paperboards in the hopper 21. A feed conveyor 30 is disposed beneath the hopper 21, and a space between the upper surface of the conveyor and the lower edge of the gate constructing member 27 can be adjusted by moving the gate constructing member 27 up or down so that the lowest paperboards **25*b* may be discharged one by one therethrough. A stacker conveyor 31 is arranged in connection with the feed conveyor 30, and a stopper 32 projects from the upper surface of the stacker conveyor and serves to stop a coming paperboard 25*c* on the stacker conveyor 31. At the inlet of the stacker conveyor 31, there is disposed a phototube 38 by which the paperboards are counted when each paperboard crosses a light toward the phototube 38**.

The stopper 32 is composed of a rotary shaft 35 for rotating intermittently in response to a counting signal from the phototube 38 and four stopper members which are disposed around the shaft 35. It should be noted that the number of the stopper members are not limited to four. The rotary shaft 35 is provided, at opposite ends thereof, with rings 36, 36', by which a pin 33 is supported rotatably. The pin 33 can be secured to the ring 36 with a stop screw 37. The stopper member 26 is mounted rockingly on the pin 33 and is urged in the rotational direction of the rotary shaft 35 by a torsion spring 34. The rocking movement of the stopper member 26 is limited to an upright position by each of pins 45 which are disposed in the rings 36, 36'. The spring tension of the torsion spring 34 can be adjusted by rotating an end portion **33*a* of the pin 33. Reference numeral 46 represents an intermittent rotation driving device connecting with the rotary shaft 35, which driving device can cause the rotary shaft to rotate every predetermined angle in response to a counting signal from the phototube 38**.

A push device 39 can be pushed and moved by a cylinder 40 in response to the aforesaid signal. A holding rod 41 is adapted to move vertically along a body of the push device 39. Reference numeral 42 represents a discharge conveyor, and above this discharge conveyor, there is arranged a press conveyor 43 which can ascend and descend.

One examplary apparatus according to the present invention may be constituted as described above, and the function of the apparatus is as follows:

As seen in FIG. 7, the paperboards 25 which have been subjected to grooving, fold formation, paste coating, and folding treatments in the previous process are introduced into the hopper 21, and their position is corrected by their sliding along the squaring plate 28. The bottom of the paperboards is supported by the supporting plate 29, and they are discharged one by one from the hopper 21 through the space between the feed conveyor 30 and the lower edge of the gate constructing member 27. The discharged paperboard **25*b* is transferred from the feed conveyor to the stacker conveyor 31, then carried by the stacker conveyor, stopped by the stopper member 26 disposed around the rotary shaft 35, and pushed up by the next coming paperboard 25*c*. In this way, a heap of the paperboards is built up. When the paperboards have been heaped up and have reached a predetermined number, the rotary shaft 35 rotates as much as an intermediate angle (generally 45°) (as in FIG. 9) in response to the signal from a counting device which can count the number of the paperboards by the passage thereof across the light directed to the phototube 38, so that the stopper member 26 releases the heaped articles 44 and the next stopper member 26*a* comes in contact with the bottom of the heaped articles 44. The torsion spring 34 which acts on the stopper 26*a* has one end thereof secured to the stopper 26*a* and another end thereof secured to the pin 33 (see FIG. 8). Therefore, the stopper 26*a* comes lightly in contact with the heaped paperboards 44 from an arrow direction, and when the next paperboard 25*d* comes and raises the heap of the paperboards, the stopper 26*a* rises with the aid of the spring action as much as the heap is raised, and the paperboard 25*d* is stopped with the tip 26*a*' of the stopper 26*a*. At that time, there occurs a deviation (l) in a horizontal direction between the heaped article group 44 and the coming paperboard 25*d* in order to facilitate the separation of the heap by the push device 39**.

The stopper **26*a* rises from a position lower than the highest position (an upright pose) every arrival of each paperboard. Further, the rotation of the rotary shaft 35 as much as the intermediate angle causes the heaped article group 44 to be released and permits it to move in an arrow direction as in FIG. 9, and in this case, the movement of the heaped article group 44 is controlled by a slant 26' of the stopper 26** to prevent the disorder of the heap.

Afterword, the push device 39 is actuated, so that the heaped article group 44 is pushed and moved along the slant 26' and is transferred to the following discharge conveyor 42. At that time, the rotary shaft 35 rotates by a predetermined angle (the movement of the stopper member **26*a* up to the state shown in FIG. 10) in response to each signal to the second et seq. paperboards which successively arrive, and the stopper member 26*a* is raised contacting with the bottom surface of the previous heaped article group 44. Finally, a contacting surface 26*a*'' becomes upright and is maintained by means of the stop pin 45. The stopper member 26*a* has a height enough to prevent the next paperboard 25*e*** from moving together with the heaped articles which are now being pushed.

The holding rod 41 of the push device 39 can slide up vertically to receive the next paperboard 25*f* from its bottom during the above pushing operation. The push device 39 returns to the original position after detecting a stroke end, and waits there. The heaped articles 44 which have been separated from the push device 39 are forwarded to a further process (a tying device) by the discharge conveyor 42 disposed at a little higher position than the stacker conveyor 31, while pressed, on the upper side thereof, by the press conveyor 43.

According to such an example of the present invention, the heaped articles are pushed and moved for their separation as soon as the next first paperboard comes onto the stacker conveyor, therefore one cycle of the heaping operation can be accomplished within 2 seconds or less. It is thus apparent that the apparatus according to the present invention can be applied to a speedy heaping treatment. Further, since a newly coming paperboard is stopped at a position deviated from the preceding heaped articles by a second stopper member, the heaped article group can be easily separated with the aid of the push device, and the accuracy of the count is also high. Furthermore, after being released from the stopper member and pushed by the push device, the heaped article group is stopped by the stopper member which has moved as much as the intermediate angle (generally 45°), therefore the disorder of the paperboard articles can be prevented. Additionally, since the heaped article group 44 moves over the stopper member 26 by means of the pushing operation, and since the discharge conveyor is arranged at the same level as the bottom of the heaped article group, the disorder of the heaped article group can be minimized. Moreover, the lightweight stopper member, which can rise and fall independently of the rotation of the rotary shaft, has the mechanism of conforming to the coming respective paperboards to be heaped up, therefore the inertia of the stopper member is inappreciable. It is thus definite that the apparatus according to the present invention can easily follow the action of a high-speed machine.

What is claimed is:

1. An apparatus for counting and collecting paperboards comprising a suitably disposed device for counting said paperboards brought by a conveyor device, means for heaping said paperboards successively from the bottom thereof by restraining their movement including a stopper disposed on the surface of a conveyor, and means for transferring them to a further process each time they are collected in a predetermined number wherein said stopper is composed of a shaft for rotating through a predetermined angle of not more than about 45° intermittently in response to a signal from said counting device, a plurality of stopper members which are disposed around said shaft and are mounted on the shaft for rocking movement relative to the shaft and which are urged in the rotational direction of said shaft, and means, disposed on said shaft, for restraining the rocking movement of each stopper member in the vicinity of an upright position thereof, and wherein rotation of the shaft through the predetermined angle rotates a first stopper member from the upright position in which paperboards are heaped into a stack to an adjacent position in which the stack of paperboards are held between the first stopper member and a second stopper member, the second stopper member retaining the next paperboard which is to be the first paperboard of a new stack.

2. The apparatus of claim 1 wherein said stopper member rises from a position lower than a level of an incoming paperboard which is to be heaped.

3. The apparatus of claim 2 wherein rotation of said shaft through said angle causes heaped paperboards to be released and moved in a predetermined direction.

4. The apparatus of claim 3 wherein movement of heaped paperboards in said direction is controlled by a slant of the stopper member to prevent disorder of heaped paperboards during said movement.

5. The apparatus of claim 1 wherein said stopper members are four or more in number.

* * * * *